United States Patent [19]

Brandstetter et al.

[11] 4,396,335

[45] Aug. 2, 1983

[54] ARRANGEMENT FOR ORDERLY PLACING OF CROSS WOUND SPOOLS

[75] Inventors: Hermann Brandstetter; Heinz-Jurgen Lohmann, both of Bissendorf, Fed. Rep. of Germany

[73] Assignee: Schubert & Salzer, Ingolstadt, Fed. Rep. of Germany

[21] Appl. No.: 317,607

[22] Filed: Nov. 3, 1981

Related U.S. Application Data

[63] Continuation of Ser. No. 78,796, Sep. 25, 1979, abandoned.

[30] Foreign Application Priority Data

Sep. 29, 1978 [DE] Fed. Rep. of Germany ..... 2842432

[51] Int. Cl.[3] ..... B65G 57/11

[52] U.S. Cl. ..... 414/91; 414/110; 414/911; 53/244; 53/260; 53/534; 53/540; 242/35.5 A

[58] Field of Search ..... 414/69, 86, 109, 110, 414/397, 911, 91; 242/35.5 A, 79; 53/244, 247, 248, 260, 534, 540; 198/422; 193/32, 2 C

[56] References Cited

U.S. PATENT DOCUMENTS

| | | | |
|---|---|---|---|
| 2,647,670 | 8/1953 | Cox | 53/248 |
| 2,942,739 | 6/1960 | Heartstedt | 414/69 |
| 3,019,581 | 2/1962 | Phillips et al. | 53/244 |
| 3,115,236 | 12/1963 | Anetsberger | 198/841 |
| 3,406,495 | 10/1968 | Beninger et al. | 198/422 |
| 3,464,529 | 9/1969 | Horsky | 193/32 |
| 3,492,779 | 2/1970 | Russell | 53/248 |
| 3,815,321 | 6/1974 | Hartman | 53/244 |
| 3,906,712 | 9/1975 | Miyazaki et al. | 242/35.5 A |

*Primary Examiner*—Joseph E. Valenza
*Attorney, Agent, or Firm*—Dority & Flint

[57] ABSTRACT

An apparatus for depositing cross wound yarn spools into an open top transport container utilizing a vertically extending dropping channel. The channel is raised and lowered into the transport container for guiding and directing the spools of yarn into the container. The container with the dropping channel provided therein is selectively moved for depositing the spools in a plurality of longitudinal rows.

20 Claims, 6 Drawing Figures

FIG. 2
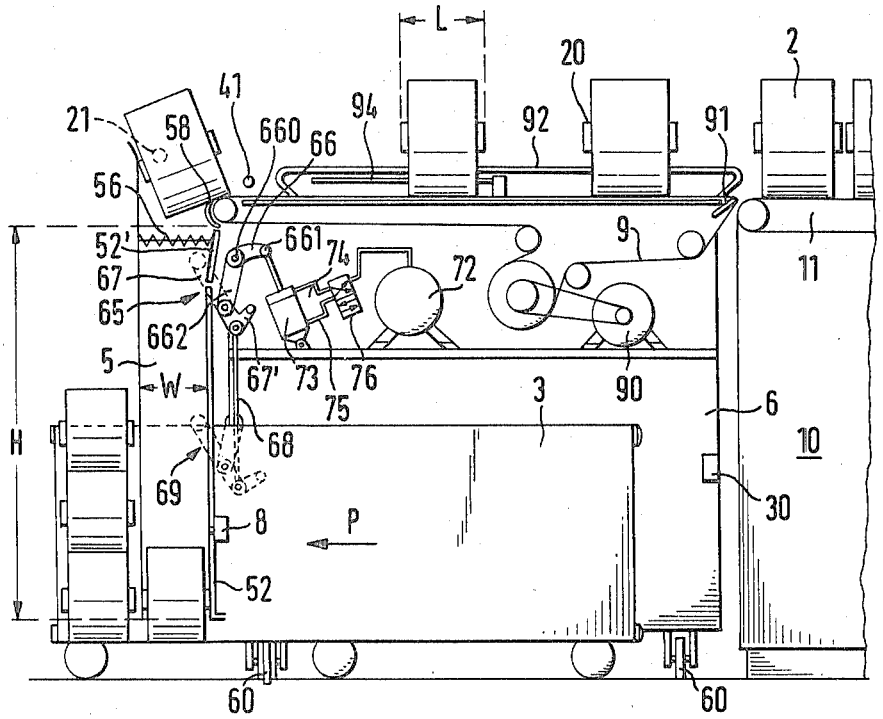
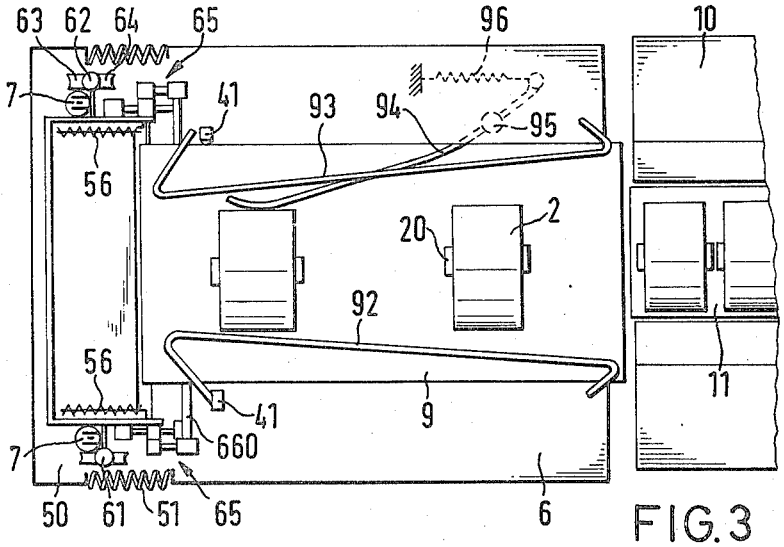
FIG. 3

ARRANGEMENT FOR ORDERLY PLACING OF CROSS WOUND SPOOLS

This is a continuation of application Ser. No. 078,796, filed Sept. 25, 1979 now abandoned.

BACKGROUND OF THE INVENTION

The present invention relates to an arrangement for orderly placing of cross wound spools into transporter containers.

The handling of the cross wound spools and their orderly depositing by hand into transporting containers, owing to the relatively large dimensions and hence correspondingly great weight of the spools, requires a high degree of physical effort and labor, which can cause industrial injuries as well as appreciable loss of time. For this reason it has already been previously proposed to mechanize the cross wound spool deposition into transporter containers, in which the objective is to achieve orderly deposition, as made possible by manual effort, also with mechanical means.

In a known arrangement for sorting, transport and depositing of wound yarn, the spools produced are ejected after passing a sorting station on to a sloping transporter, which delivers these spools upwards to grabs which are held on endless, recirculating chains and which engage with the spool sleeves (DE-OS No. 2.637.998). The spools are guided then by means of the grabs over support mandrels, which are held on a pallet and they are dropped, after being released by the grab jaws, on these mandrels. Orderly depositing is of course possible by insertion of the wound spools on support mandrels. However, this arrangement is of complicated design and therefore expensive. It requires also a special pallet or container with support mandrels, the spacing between each of which must correspond to the specified spool diameters if the accommodation capacity of the pallet is to be dully utilized, which is desired in all cases. There exists additionally the danger that the wound yarn, on collision of spool sleeves on the bottom plate or against the sleeve of an already deposited spool, will be displaced and the sleeves will become damaged so that they become unusable after a short time and interfere with winding of the yarn from the spool.

It is further known, to feed the spools taken from the spooling station of a textile machine, for the purpose of orderly depositing by means of a transporter belt and a sliding plate to a fixed position or travelling ejection arrangement from which, lying in a horizontal position, they are ejected into a spool trolley provided with channels (U.S. Pat. No. 3,906,712). This arrangement also requires specially constructed spool trolleys, in which the width of their channels must be adapted, for full utilization of the loading space, to the specified diameter of the spools to be deposited. Since the spools, in the same manner as in the first mentioned arrangement, are ejected in horizontal position, so that the spool sleeves hence stand vertically, there exists also here the possibility of a displacement of the yarn wound on the spool sleeve and damage to the spool sleeves. Further, it is necessary in this known kind of spool deposition, to shift the spool trolleys, after filling one of the channels, by hand or by a special drive, for which purpose either an operator must be continuously available or the equipment design must become more complicated.

SUMMARY OF THE INVENTION

This task is solved according to the invention by using a basically vertical dropping channel, whose width corresponds in the feed direction of the transporter container to the length of a yarn spool sleeve.

Hence it is now possible to deposit the yarn spool in standing position into a transporter container in which they arrange themselves by rolling. In this manner the depositing of yarn spools remains independent of the diameter of the spools and the sleeves remain free from damage.

In a further embodiment of the invention, the dropping channel can be lowered from an upper end position into the transporter container, by means of which the yarn spools will receive a corresponding guiding movement up to within the transporter container. This guiding arrangement is further improved by the fact that the dropping channel can be lowered down to the bottom of the transporter container. In order to reduce the danger of accidents and damage of the dropping channel, the dropping channel can therefore be lowered by its own weight under braking. By the fact that the dropping channel can be moved in its lowered condition by a greater extent than one spool sleeve length in the horizontal direction, a correspondingly large displacement of the transporter container is caused without manual intervention or special drive. In this case, on the one hand, the yarn spool rows in the transporter container are tightly packed against each other, on the other hand, the dropping channel can be lowered repeatedly with sufficiently large spacing from the last yarn spool row into the transporter container, so that no damage to the deposited spools is caused by the dropping channel.

A matching of the horizontal movement of the dropping channel to the length of the yarn spool sleeves is achieved by the fact that the horizontal feed movement of the dropping channel can be adjusted. In order to avoid damage to the yarn spools from a great dropping height, the rear wall of the dropping channel can be deformed inwards elastically. It acts hence as a brake arrangement for the falling yarn spools. Usefully, the rear wall of the falling channel consists of two walls arranged a distance apart from eath other, of which the inner wall can be deformed inwards elastically. This arrangement has the advantage that the outside wall can be used as a support for the elements causing deformation, so that in the case of a displacement of the whole rear wall these also always retain the same distance relative to the inner wall. Preferably, the rear wall is pushed inwards by at least one of the air pistons which cause elastic deformation. In order to retard the dropping velocity of those spools, which have the longest dropping path, the deformation position is arranged at a distance from the lower end of the dropping channel, which corresponds at least to half the diameter of one spool. Braking tuned to the rhythm of the falling of the yarn spools and the repeated releasing of the yarn spools becomes possible by the fact that the deformation can be controlled by means of a yarn spool scanning arrangement arranged in the vicinity of the filling opening of the dropping channel.

The use of the dropping channel for spools of different widths and hence with corresponding sleeve lengths is insured by the fact that the width of the dropping channel can be adjusted relative to the length of the yarn spool sleeve length. In order to utilize fully the accommodation capacity of any existing transporter container, the height of the dropping channel can be matched to the filling height of the widest transporter container to be loaded. Application of transporter containers with different widths is made possible by the fact that the width of the dropping channel is smaller than the width of the narrowest transporter container to be loaded. The number of the yarn spools to be deposited in each row in the transporter containers can be adjusted in order to accommodate in an orderly manner into the containers a number of yarn spools corresponding to the filling height of the transporter container to be loaded.

The fact that one rear wall of the dropping channel is made swivelling in its upper part insures that the dropping channel can be moved also past an obstruction on channel movement from the lower position into an upper position. The swivelling movement of the wall can be usefully controlled in relation to the lifting movement of the dropping channel. In an especially simple embodiment cams are provided which cause swivelling movement. This arrangement makes possible disturbance-free transfer of spools with relatively small diameters in the dropping channel, in which the width of the filling opening of the dropping channel can be restricted. This is carried out in a simple manner by a guide rod for spools arranged in a region in the filling opening.

Into the dropping channel is arranged a transporter belt for a continuous filling of the spools. Guide means for the spools are arranged on both sides of the transporter belt so that the spools are guided on the transporter belt reliably in the direction of the dropping shaft. The guiding of the spools at all times towards one side of the dropping channel which insures hence uniform loading of the transporter container is insured by the fact that one of the guiding means is arranged to move flexibly across the running direction of the transporter belt.

The dropping channel and the transporter belt are arranged on a trolley in order to move the dropping channel to different application locations. An arresting of the trolley on its application position is insured in simple manner by the fact that the transporter container can be shifted across the travelling direction of the trolley into a frame which guides the dropping channel. The transporter container can be clamped into the trolley so that it can be shifted for fixing of the transporter container in and against its inwards shifting direction. This is carried out usefully by means of the spring loaded rollers held on the trolley; these said rollers press against the transporter container. Damage to the transporter container upon displacement of said container after depositing of one row of spools is hence avoided. A second transporter belt is advantageously provided which delivers the spools to the transporter belt associated with the dropping channel, in which the transport velocity of the transporter belt associated with the dropping channel is greater than that of the second transporter belt. Hence on the one hand, for the corresponding length of the second transporter belt, it is possible to supply spools to the dropping channel from remote positions, on the other hand, owing to the differences in the transporter velocities an alignment of the spools follows so that the said spools reach into the dropping channel standing in accurately parallel position to the dropping channel. Reduction of the spacing between both transporter belts and hence a disturbance free transfer of the spools from the second transporter belt onto the transporter belt associated with the dropping channel becomes possible by the fact that the span of the transporter belt associated with the dropping channel which faces the second transporter belt is guided over a knife edge.

Accordingly, it is an important object of the present invention to provide an arrangement for orderly depositing of cross wound yarn spools in transport containers.

Another important object of the present invention is to provide a simple and gentle apparatus for depositing cross wound yarn spools into conventional transporter containers.

Another important object of the present invention is to provide an apparatus for depositing cross wound yarn spools into conventional transport containers insuring the best possible utilization of their holding capacity.

These and other objects and advantages of the invention will become apparent upon reference to the following specification, attendant claims and drawings.

BRIEF DESCRIPTION OF THE DRAWINGS

FIG. 2 is the arrangement according to FIG. 1 viewed from the side, FIG. 3 is the arrangement according to FIG. 1 in plan view.

DESCRIPTION OF A PREFERRED EMBODIMENT

The arrangement according to the invention can be used for textile machines of various kinds which produce cross wound yarn spools, for depositing of the spools and it can be stationary or mobile. It can, however, also be used independently for such machines, for example in the packing area for orderly deposition of cross wound yarn spools into boxes ready for dispatch.

Figure 1:
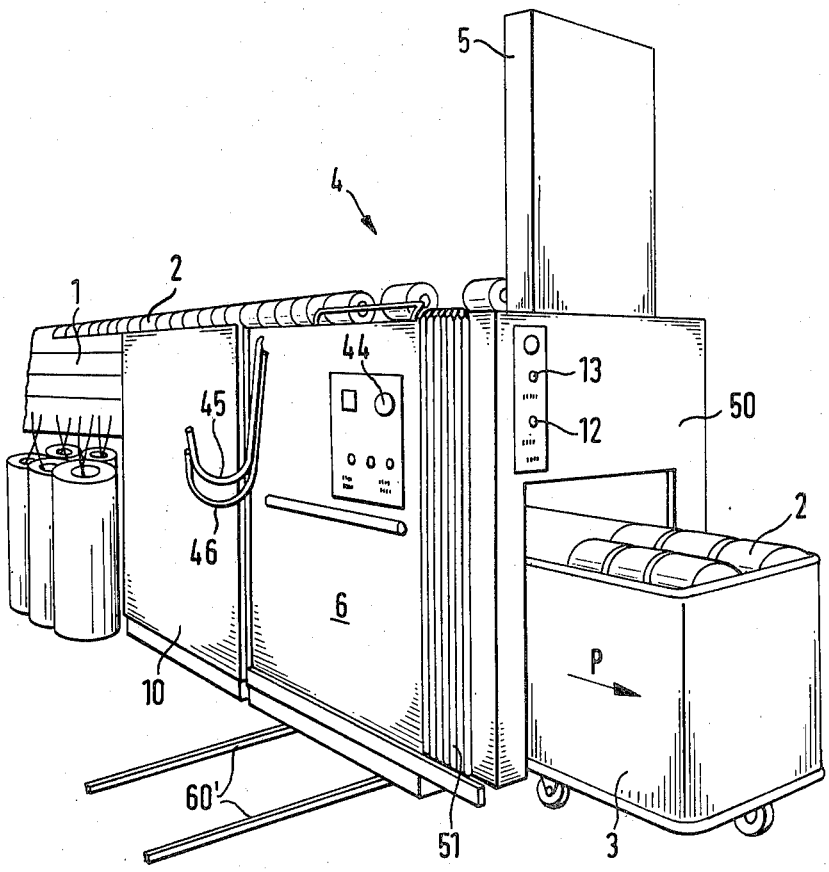
FIG. 1 is a yarn spool deposition arrangement according to the invention designed as a mobile unit in perspective view.

Its application for example as a travelling depositing arrangement for cross wound yarn spools produced on an open end spinning machine is described below. FIG. 1 shows a partial view of such an open end spinning machine 1 with an end frame 10. The cross wound yarn spools 2 which are made on the spool stations of the machine, which said spools have basically equal diameters, are already deposited on a transporter belt 11 (FIG. 2), which said belt projects above the working stations of the open end spinning machine 1 over its length.

The orderly depositing of the cross wound yarn spools 2 into a transporter container 3 is carried out by a spool depositing arrangement 4, which is arranged on the end face of the end frame 10 of the open end spinning machine 1 and which has a vertical dropping channel 5 guided in a frame 50. The frame 50 is held on a trolley 6 and connected by means of a lever system 65 and 69 with the trolley 6, in which the said levers are covered with a bellows 51, the wheels 60 (FIG. 2) of the said trolley run on rails 60' arranged across the machine rows. The spool depositing arrangement 4 can hence be moved by hand; if necessary it can also be driven by a motor from machine to machine. The frame 50 and the trolley 6 form a U-shaped tunnel (FIGS. 1 and 2), into which can be pushed a transporter container 3, which is a conventional yarn spool trolley in the textile industry when the dropping channel 5, which is open at top and bottom, is in its upper end position shown in FIG. 1. After depositing one row of cross wound yarn spools 2 in the transporter container 3 the transporter container 3 is pushed out in the forward direction P by more than one yarn spool sleeve length from the frame 50 which will be described in greater detail.

Figure 5:
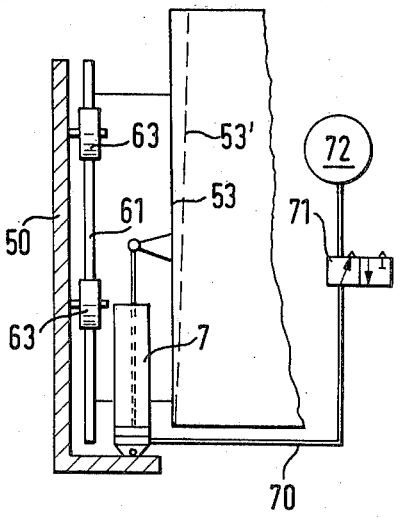
FIG. 5 is the dropping channel with guiding and drive arrangement for vertical movement, viewed from the front.
Figure 6:
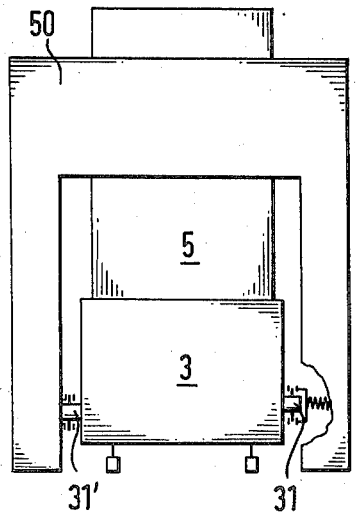
FIG. 6 is the arrangement according to FIG. 2 with slidable clamped transporter container.

The dropping channel 5 can be lowered from the upper end position into the transporter container 3 (FIG. 2), preferably down to the bottom of the transporter container 3 or at least to said bottom vicinity, so that the cross wound yarn spools 2, which are deposited into the transporter container 3 in the lowermost layer, will be definitely guided down to their deposited positions. The definite and constant guiding of the dropping channel 5 on its lifting and lowering movement in the frame 50 is carried out by guiding rods 61 and 62 in conjunction with guide rollers 63 and 64 to both sides of the dropping channel 5 (FIGS. 3 and 5). The guiding rods 61 and 62 are rigidly connected with the dropping channel 5 and slide in the guide rollers 63 and 64 arranged in pairs, the said guide rollers being fastened on the frame 50. The movement of the dropping channel 5 out of its lowered position into the upper end position is carried out by two compressed air cylinders 7, which are held on both sides of the dropping channel 5 in fixed position in the frame 50 and which are connected by a compressed air pipeline 70 with an intermediate connected valve 71 to a compressed air generator 72.

The dropping channel 5 can be moved further by more than one length L of a yarn spool sleeve in the horizontal direction (FIG. 2). The horizontal movement is imparted to the dropping channel 5 by a compressed air cylinder 73, which is arranged preferably centrally to the dropping channel 5 in the trolley 6 and it actuates the lever linkage 65 and 69. The compressed air cylinder 73 is connected by means of compressed air pipelines 74, 75 and an associated valve 76 with the compressed air generator 72. The piston rod of the compressed air cylinder 73 engages with the free arm of a lever 66 fastened on the shaft 660. The shaft 660 can rotate in the trolley 6 and transmits the movement by means of the swing arm 662 held on it on the link arms 67 on both sides of the dropping channel. The link arms 67 are connected additionally by the brackets 67' with the trolley 6 so that they can swivel.

Two connecting levers 68 transmit the movement of the lever linkage 65 to an identical, lever linkage pair 69 situated below the first mentioned said lever linkage 65. The forward movement of the dropping channel 5 in the horizontal direction can be adjusted by displacing the joint 661 on the lever 66, so that it can be matched to the given existing length L of the spool sleeves 20.

Figure 4:
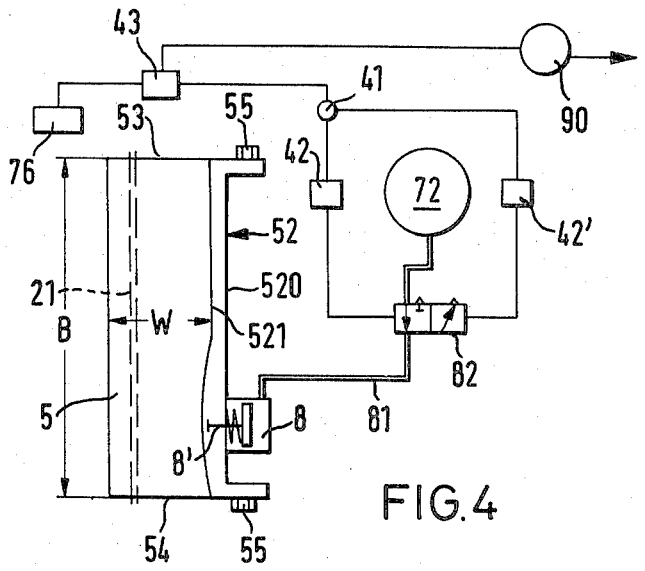
FIG. 4 is the dropping channel in plan view with a switching diagram.

On viewing in the forward movement direction P of the transporter container 3 the dropping channel 5, which is open at top and bottom, has a clear width W, which is slightly greater than the length L of the spool sleeves 20 of the cross wound yarn spools 2, so that the cross wound yarn spools 2 can readily slide through the dropping channel 5 (FIGS. 2 and 4). Since the dropping channel 5 must be capable of being used, according to the industrial requirements, for a wide range of sleeve lengths, therefore the width W which corresponds to the given spool sleeve length must also be adjustable in addition to the forward movement in horizontal direction. For this purpose for example, the rear wall 52 (viewed opposite the forward movement direction P of the transporter container 3) is bent away on both sides and fastened with screws 55 on the side walls 53, 54 of the dropping channel 5, which said screws pass through the longitudinal slots (FIG. 4).

The height H (FIG. 2) of the dropping channel 5 is matched to the filling height of the widest transporter container 3 whose loading is to be carried out with the yarn spool depositing arrangement 4 so that there is sufficient space in the dropping channel 5 also for the cross wound yarn spools 2 which are to be deposited in one row in such transporter containers. The width B of the dropping channel is advantageously designed in relation to the narrowest transporter container to be loaded and it is smaller than that of the narrowest transporter container. Hence it is possible to deposit the cross wound yarn spools 2 equally well into such narrow transporter containers 3 as well as into wider ones. Usefully, the width B of the cropping channel 5 is 10% smaller than that of the narrowest transporter container 3. This is sufficient in order to lower the dropping channel with a sufficient safety distance from the side walls of the transporter container 3.

If the cross wound yarn spools 2 are thrown from great height into the dropping channel 5 or into the transporter container 3, then there exists the danger that they can become damaged. In order to prevent this damage the rear wall 52 of the dropping channel 5 is elastically deformable and it is pushed inwards on ejecting a cross wound yarn spool 2, whence a braking effect is exerted on the cross wound yarn spool. According to FIG. 4, the rear wall 52 consists of two walls 520 and 521 arranged at a distance from each other, of which the inner wall 521 can be deformed elastically and it can be pressed inwards, towards the middle of the dropping channel 5. This bulging of the inner wall 521 is carried out by the piston rod 8' of a compressed air cylinder 8, which is fastened on the outside wall 520, and is connected by means of compressed air pipelines 80 and 81 and also with interconnected valve, for example by a solenoid valve 82, to the compressed air generator 72. For inwards pushing of the inner wall 521 at least one compressed air cylinder 8 is provided and this is arranged so that the deformation position defined by its piston rod 8' is situated at a distance from the lower end of the dropping channel, which corresponds at least to the half diameter of a cross wound yarn spool 2 (FIG. 2).

The elastic deformation of the inner wall 521 can, if necessary, also be carried out by other means, for example by cams or air cushion arranged between the two walls 520 and 521. Similarly, instead of a double wall also a single, elastically deformable wall can be used as rear wall and the deformation causing means are fastened on the trolley 6. The design of the rear wall 52 as double wall, however, is preferred because in this case the deformation means can be fastened on the outside wall 520 and hence also on changing the clear width W of the dropping shaft 5 by displacing the rear wall 52 it retains its specified distance relative to the inner wall 521.

The dropping channel 5 has a transporter belt 9, which is held on the trolley 6 and which bridges the intervening space between the second transporter belt 11 associated with the open end spinning machine 1 and which also bridges the filling opening of the dropping channel 5 (FIGS. 2 and 3). A motor 90 drives the transporter belt 9 guided over guiding rollers in such a manner that its transporting velocity is greater than the transporting velocity of the second transporter belt 11 associated with the open end spinning machine 1. The height of the span of the transporter belt 9 which transfers the cross wound yarn spools 2 to the dropping channel 5 is matched to that of the second transporter belt 11. The transporter belt 9 side facing the second transporter belt 11 is guided over a knife edge 91. The distance between the two transporter belts 9 and 11 can hence be kept so small that a disturbance free transfer of the cross wound yarn spools 2 from the second transporter belt 11 is insured to the transporter belt 9.

The transporter belt 9 has on both sides guiding means, which insure the aligned transport of the cross wound yarn spools 2 to the dropping channel 5. These are rigid guide rails 92 and 93 held on the trolley 6 as well as a moving guide arm 94. The latter can be swivelled about a fixed axis 95 and it is pulled by a tension spring 96 in the direction towards the middle of the transporter belt 9. Above the transporter belt 9, in the vicinity of the filling opening of the dropping channel 5 is arranged a yarn spool scanning arrangement 41, which in the embodiment illustrated includes a light barrier. As shown diagrammatically in FIG. 4, the solenoid valve 82 and hence the deformation of the inner wall 521 of the rear wall 52 by the piston rod of the compressed air cylinder 8 is controlled in relation to the yarn spool scanning arrangement 41 by means of a timing element 42 or 42'.

The yarn spool scanning arrangement 41 is additionally connected also with a counting arrangement 43 used to count a specified number of cross wound yarn spools 2 to be deposited in one row in the transporter container and after reaching of this number the delivery of cross wound yarn spools to the dropping channel 5 is interrupted. The setting of the counting arrangement 43 to a specified number of cross wound yarn spools 2, which depends on the diameter of the yarn spools and the size of the container, is carried out by means of a preselector switch 44 on the trolley 6 (FIG. 1). The counting arrangement 43 is connected for control purposes with the motor 90 of the transporter belt 9, the motor (not shown) of the second transporter belt 11, and with the valve 76 of the compressed air cylinder 73 which causes the horizontal movement of the dropping channel 5.

In order to prevent the cross wound yarn spools 2 colliding when sliding off the transporter belt 9 against the upper edge of the rear wall 52 when being dropped into the channel which can obstruct their dropping or cause their tilting, the rear wall 52 is designed to swivel in its upper part 52' and it is pushed by compression springs 56 under the transporter belt 9 (FIGS. 2 and 3). The swivelling movement of the upper part 52' of the rear wall 52 is controlled in relation to the lifting movement of the dropping shaft 5 by cams 58, which are arranged on both sides of the transporter belt 9.

The mode of operation of the yarn spool depositing arrangement 4 is as follows:

After the completion of the cross wound yarn spools 2 on an open end spinning machine 1 the cross wound yarn spools 2 are deposited standing and basically parallel to the dropping channel 5 on the second transporter belt, which projects over the length of the open end spinning machine 1, and the yarn spool depositing arrangement 4 is pushed for example by hand to the machine and arranged in front of its end frame 10 so that the transporter belt 11 and the transporter belt 9, associated with the dropping channel 5, are aligned.

The positioning of the arrangement can, if necessary, be supported by a limit switch arranged on the end frame 10, in connection with cams (not shown). During the travel of the yarn spool depositing arrangement 4 the dropping channel 5 is situated for safety reasons in its lowered position. After that a connection is established with the power mains by means of cable connections 45, 46 which are inserted into the socket on the end frame 10 and by actuating a main switch, so that the compressed air generator 72 will start up. On manual actuation of a switch 12 on the frame 50 (FIG. 1) the valve 71 is opened. The compressed air which hence flows into the compressed air cylinder pushes its piston and hence the dropping channel 5 out of the lowered position into the upper end position.

Now the transporter container 3 is displaced across the travelling direction of the yarn spool depositing arrangement 4 into the frame 50 and the trolley 6 up to a stop 30. In doing this the transporter container is clamped between spring loaded rollers 31 and rigid rollers 31', in which the rollers 31 are pressed against the transport container 3. The rollers are fixed on the trolley 6. The clamping pressure is adjusted so that the transporter container is arrested during the spool deposition; however, it is still capable of being displaced. The yarn spool deposition arrangement 4 is arrested by the insertion of the transporter container 3 across its travelling direction, so that a coupling with the open end spinning machine need not be carried out. The valve 71 is closed by the actuation of a switch 13 on the frame 50. Hence the air supply into the compressed air cylinder 7 is interrupted and the air in the compressed air cylinder 7 can escape through a pipeline of the valve 71 connected to the free atmosphere. The dropping channel 5 sinks, due to its own weight, into the transport container 3, in which, however, its own weight is braked by the air still in the compressed air cylinder 7 which flows out of it only slowly. Hence damage to the dropping channel and accidents are avoided. Additionally, the lower edge of the dropping channel 5 can be provided with a contact profile (not shown), which insures movement reversal of the dropping channel 5 on meeting obstructions.

Subsequently, the number of the cross wound yarn spools 2 to be deposited in one row into the transporter container is preset on the preselector switch 44 of the counting arrangement 43 and the motor 90 of the transport belt 9 as well as the drive motor of the second transport belt 11 are switched on. The cross wound yarn spools 2 arranged vertically on a transport belt 11 arrive hence, one after the other, on the transporter belt 9. Since the transport velocity of the transporter belt 9 is greater than that of the transporter belt 11, the cross wound yarn spools 2, as long as they are not yet parallel to the dropping channel 5, are therefore accordingly aligned on transition from the transporter belt 11 to the transporter belt 9 and are brought into parallel position. The cross wound yarn spools 2 are hence accurately aligned and transported by the guide rails 92 and 93 as well as by the guide arm 94 from the transporter belt 9 to the filling opening of the dropping channel 5. On doing this the flexible guide arm 94 pushes the cross wound yarn spools 2 to one side of the transporter belt 9, in the embodiment example in the direction towards the guide rail 92, so that the cross wound yarn spools 2 will always arrive on the same side of the dropping channel 5 into this said channel. This insures a uniform charging of the transporter container 3. According to FIG. 2 the cross wound yarn spool 2 arriving at the filling opening of the dropping channel 5 is supported at first with its upper part on the front wall of the dropping channel 4 and it slides subsequently, on pushing by the transporter belt, into the dropping shaft 5, through which it drops in vertical position on the floor of the transporter container 3.

Before the cross wound yarn spool 2, however, arrives at the filling opening of the dropping channel 5, it passes the yarn spool scanning arrangement 41, which subsequently generates a pulse to the counting arrangement 43 as well as to the timing elements 42, 42' connected between the yarn spool scanning arrangement 41 and the solenoid valve 82 of the compressed air cylinder 8.

The timing element 42 takes into account the time which the cross wound yarn spool requires for the travel from the yarn spool scanning arrangement 41 up to the vicinity of the rear wall 52 part designed for deformation or its inner wall 521. After the cross wound yarn spool 2 has arrived in the vicinity of this position, the timing element 42 causes, by the opening of the solenoid valve 82, the delivery of compressed air through the compressed air pipeline 81 into the compressed air cylinder 8, so that the piston rod 8 pushes the elastically deformable inner wall 521 inwards. The cross wound yarn spool 2 is braked by this contraction of the clear width W of the dropping channel 5 on its fall. Directly subsequently to that the compressed air supply through the compressed air pipeline 81 is interrupted by the timing element 42' and the compressed air cylinder 8 is vented, whence the piston rod 8' moves away due to the restoration spring from the inner wall 521 and the cross wound yarn spool 2 is released, which now drops from a slight height, without danger of damage, into the transporter container. This process is repeated continuously, in which now the subsequent cross wound yarn spools 2 will fall on those situated already in the dropping channel 5, roll away from there and hence are automatically ordered within the dropping channel 5.

After the number of cross wound yarn spools 2 specified by means of the preselector switch 44, is deposited in the dropping channel then there is triggered by the counting arrangement 43, which generates a control pulse, the stopping of the motor 90 of the transporter belt 9 and of the motor of the second transporter belt 11 as well as opening of the valve 76 for the supply of compressed air through the compressed air pipe 74 into the compressed air cylinder 73. The compressed air flowing into the compressed air cylinder 73 drives the piston of this cylinder downwards, so that the piston rod exerts a pull on the bell crank 66 and the frame 50 with the channel 5 is moved by the lever linkage 65 and the latter with the connected lever linkage 69 in horizontal direction by slightly more than the length L of a spool sleeve. This carries along the transporter container 3 by overcoming the clamping pressure exerted on it by the rollers 31, away from the dropping channel 5 in the forward movement direction P. If, as shown in FIG. 2, there is deposited already a row of cross wound yarn spools 2 into the transport container, then the dropping channel presses, due to its horizontal movement, against the spool sleeves and pushes the cross wound yarn spool 2 against, on viewing opposite the forward movement direction P, front end wall of the transporter container 3. In this manner, on progressive filling of the transporter container 3, the cross wound yarn spool rows are packed closely against each other and the fillig space of the transporter container 3 is used to the best possible extent.

After the frame 50 and the dropping shaft guided in it have completed their horizontal movement then the dropping channel 5 is driven from its lowered position into the upper end position, back in the direction towards the transporter belt 9 into its initial position and it then is lowered again into the transporter container 3. These movements are caused automatically by a corresponding control arrangement, in which at first the dropping channel is moved upwards by the compressed air flowing through the compressed air pipeline 70 into the compressed air cylinder 7, and after the arrival into its upper end position it is displaced, by the compressed air supply to the compressed air pipeline 75 into the compressed air cylinder 73, towards the transporter belt 9. Then the dropping channel is lowered by changeover of the compressed air valve 71 and the venting of the compressed air cylinders 7. The lowering can be caused also by manual switching.

If the width B of the dropping channel 5 is only slightly smaller than the width of the transporter container 3 to be loaded, then the cross wound yarn spools 2 remain on the upward movement of the dropping channel 5 in the transport container 3 into the ordered positions, in which they were deposited in the dropping channel. On using a dropping channel 5 which, however, for example has only half the width of the transporter container 3 whose height H, however, is sufficient for accommodating the cross wound yarn spools 2 to be deposited in a row in the transporter container 3, then the cross wound yarn spools 2 are placed in orderly manner, after their release through the dropping channel 5 in the transporter container automatically, in which they roll away from each other into the free space.

On the already described lowering of the dropping channel 5 by its own braked weight, a swivelling movement of the upper part 52' of the rear wall 52 is controlled in relation to the lifting movement of the dropping channel 5 by the cam 58, which, in the course of the lowering movement, cause at first the swivelling of the upper part 52' against the force of compression spring 56 inwards in the direction towards the middle of the dropping channel 5 and this part in the end phase of the lowering movement is again released, so that it can be pushed by the compression spring 56 under the transporter belt 9. By repeated lowering of the dropping channel 5 down to the bottom of the transporter container 3 or its vicinity the previously deposited row of the cross wound yarn spools 2 in the transporter container is not influenced, because as described above, the transporter container 3 has been shifted by the dropping channel on the horizontal movement of the latter in the direction P by a distance greater than the length L of a sleeve. Due to this the channel arrives in a corresponding distance away from this cross wound yarn spool row into the transporter container 3.

The supporting of the cross wound yarn spools 2 shown in FIG. 2 on viewing opposite the forward movement direction P, on the front wall of the dropping channel 5 before its ejection into the dropping channel requires a correspondingly large diameter cross wound yarn spool. In order, however, to also transfer cross wound yarn spools having a relatively small diameter in the dropping channel 5, so that they do not tilt here and will not jam into the dropping channel 5, the width of the filling opening of the dropping channel 5 is limited. This is insured by a guide bar 21 for the cross wound yarn spools 2, as shown in FIGS. 2 and 4. The cross wound yarn spools 2 arriving on the transporter belt 9 are supported on the guide bar 21 which is inserted in the holder on the side walls 53 and 54 of the dropping channel 5 and they will drop vertically standing in the dropping channel 5. In place of a guide bar 21 a restriction of the filling opening of the dropping channel 5 can be provided if necessary, by the swivelling of the upper part of the front wall of the dropping channel 5, which is accordingly designed in swivelling form.

The arrangement according to the invention can have further modifications beyond the initially mentioned stationary arrangements. Hence, for example the dropping channel 5 can be integrated into the end frame of a machine and the transporter belt 9 associated with the dropping channel 5 can be neglected, if the second transporter belt 11 associated with the machine is extended up to the filling opening of the dropping channel 5 and the cross wound yarn spools 2 are arranged in advance parallel to the dropping channel 5 on the transporter belt 11, so that an alignment of the vertically standing cross wound yarn spools, as carried out by the higher transport velocity of the transporter belt 9 in relation to that of the transporter belt 11, remains superfluous. Similarly, the compressed air cylinders can be replaced by other driving means and in place of flexibly arranged rollers, for example leaf springs can be used for clamping of transporter container. Further the dropping channel can be lowered by a drive.

In another embodiment of the arrangement according to the invention the dropping channel 5 is designed so that its width B in the direction of its lower end will increase. This is indicated in FIG. 5 by a side wall 53' which limits laterally the dropping channel instead of the side wall 53. By this means jamming of the dropping channel 5 on the upwards travel by the cross wound yarn spools situated in the dropping channel 5 will be avoided.

While a preferred embodiment of the invention has been described using specific terms, such description is for illustrative purposes only, and it is to be understood that changes and variations may be made without departing from the spirit or scope of the following claims.

What is claimed is:

1. An apparatus for depositing cross wound yarn spools into an open top transport container comprising:

an open top vertical dropping channel extending into said transport container;

said dropping channel including front and rear walls joined by side walls, said front and rear walls being spaced apart a distance slightly greater than the length of said yarn spool for receiving and guiding said spool therebetween into said transport container;

means shifting said dropping channel and transport container horizontally in a first direction a distance corresponding to the length of a spool facilitating the deposit of more than one vertical row of said spools in said container;

means conveying said spools in said first direction to said open top of said dropping channel for depositing same in said container;

means selectively raising said channel out of said transport container after a vertical row of said yarn spools stacked upon one another has been deposited; and means for selectively lowering said channel into said transport container after shifting of said container positioning said channel next adjacent said vertical row previously formed whereby successive vertical rows are formed along the length of said container in said first direction.

2. The apparatus as set forth in claim 1 further comprising:

said shifting means includes means for shifting said channel a distance in said first direction greater than the length of a spool, said channel abutting a previously formed vertical row of said spools urging same in said first direction facilitating compact loading while shifting said container horizontally.

3. The apparatus as set forth in claim 1 further comprising:

said shifting means including adjusting means varying the distance said channel shifts horizontally.

4. The apparatus as set forth in claim 1 further comprising:

means deforming said rear wall of said channel elastically inwards.

5. The apparatus as set forth in claim 1 further comprising:

said rear wall including a pair of walls spaced apart from each other defining an inner and outer wall; and means for elastically deforming said inner wall of said pair of walls inwardly.

6. The apparatus as set forth in claim 5 wherein said means for elastically deforming said inner wall includes a compressed air cylinder.

7. The apparatus as set forth in claim 5 further comprising:

means for elastically deforming said inner wall at a distance from the lower end of said dropping channel which corresponds at least to half the diameter of a cross wound yarn spool retarding the fall of same before engaging said container at the lower end of said channel.

8. The apparatus as set forth in claim 5 further comprising:

a yarn spool scanning means for detecting the presence of a spool adjacent the top of said channel for activating said means for elastically deforming said inner wall respectively thereto.

9. The apparatus as set forth in claim 1 further comprising:

means for adjusting the distance between the front and rear walls of said channel to accommodate yarn spool sleeves of different lengths.

10. The apparatus as set forth in claim 1 further comprising:

an upper part of said rear wall being swivable;

means for swivelling said rear wall;

means for controlling the swivelling movement of said upper part of said rear wall inwardly towards the interior of said channel responsive to raising to said dropping channel.

11. The apparatus as set forth in claim 10 further comprising:

cam means for causing said swivelling movement responsive to said raising of said channel.

12. The apparatus as set forth in claim 1 further comprising:

a transport belt for conveying said spools to said open top dropping channel in said first direction.

13. The apparatus as set forth in claim 12 further comprising:

guide means carried on the side of said transport belt for guiding said spools thereon.

14. The apparatus as set forth in claim 12 further comprising:

a trolley carrying said transport belt and said dropping channel.

15. The apparatus as set forth in claim 14 further comprising:

a frame for guiding said dropping channel; and means for shifting said trolley in a direction transverse to said first direction in which said container is shifted.

16. The apparatus as set forth in claim 14 further comprising:

means for clamping said transport container in said trolley facilitating shifting of said container by engagement by said dropping channel.

17. The apparatus as set forth in claim 12 further comprising:

a second transport belt for delivering cross wound yarn spools to said first mentioned transport belt; and means for driving said second transport belt at a slower speed than said first mentioned transport belt.

18. The apparatus as set forth in claim 1 further comprising:

said dropping channel increasing in width towards its lower end.

19. An apparatus for depositing cross wound yarn spools into an open top transport container comprising:

an open top vertical dropping channel extending into said transport container said channel having front and rear walls, said front and rear walls being spaced apart a distance slightly greater than the length of the sleeve of said yarn spool for receiving and guiding said spool therebetween into said transport container;

means conveying said spools to said open top of said channel for deposit in said container;

said channel depositing said spools forming a vertical row of spools stacked vertically upon one another;

said channel having a lowered position in which said spools are deposited therein and a raised position in which said channel is raised above said spools;

means raising and lowering said channel; and means shifting said channel horizontally in a first direction when in said lowered position urging said channel against a previously formed vertical row compacting said spools in said container and shifting said container to accommodate the deposit of another row of said spools;

whereby successive vertical rows of said spools are formed in said container.

20. The apparatus of claim 19 further comprising means shifting said channel horizontally opposite to said first direction after said channel has been raised.

* * * * *